US005709187A

United States Patent [19]

Jaeger et al.

[11] Patent Number: 5,709,187

[45] Date of Patent: Jan. 20, 1998

[54] FLAME ARRESTOR

[75] Inventors: Matthew W. Jaeger; Richard C. Todhunter, both of Stillwater, Okla.; David J. Dickson, DesMoines, Iowa; Douglas P. McIntire, Daveville, Va.

[73] Assignee: Brunswick Corporation, Lake Forest, Ill.

[21] Appl. No.: 641,209

[22] Filed: Apr. 30, 1996

[51] Int. Cl.[6] ..... F02M 35/10

[52] U.S. Cl. ..... 123/198 D

[58] Field of Search ..... 123/198 D, 184.53, 123/3, 179.25, 572, 146.5 R, 184.34; 431/346, 328

[56] References Cited

U.S. PATENT DOCUMENTS

| | | | |
|---|---|---|---|
| 3,884,201 | 5/1975 | Cregam | 123/572 |
| 3,889,649 | 6/1975 | Polaner | 123/572 |
| 4,512,296 | 4/1985 | Herrington et al. | 123/146.5 R |
| 5,072,704 | 12/1991 | Webb | 123/179.25 |
| 5,203,296 | 4/1993 | Hart | 123/198 D |
| 5,357,913 | 10/1994 | Okumura et al. | 123/572 |

*Primary Examiner*—Marguerite McMahon

*Attorney, Agent, or Firm*—Andrus, Sceales, Starke & Sawall

[57] ABSTRACT

A flame arrestor (70) for a marine engine (12) includes an air box (72) mounted to the combustion air intake (14), and a uniplanar flame arresting element (78) mounted to the air box (72) and passing combustion air therethrough in a first direction (80) into the air intake (14) and blocking flame propagation in a second opposite direction out of the air intake (14). Air flow from the flame arresting element (78) to the air intake (14) is rectilinear.

33 Claims, 3 Drawing Sheets

10
12
14
16
18
20
22
24
26
28
30
32
34
36
38
40
42
44
46
48
50
52
54
56
58
60
62
64
66
68
70
72
74
75
76
78
80
122

FIG. 6
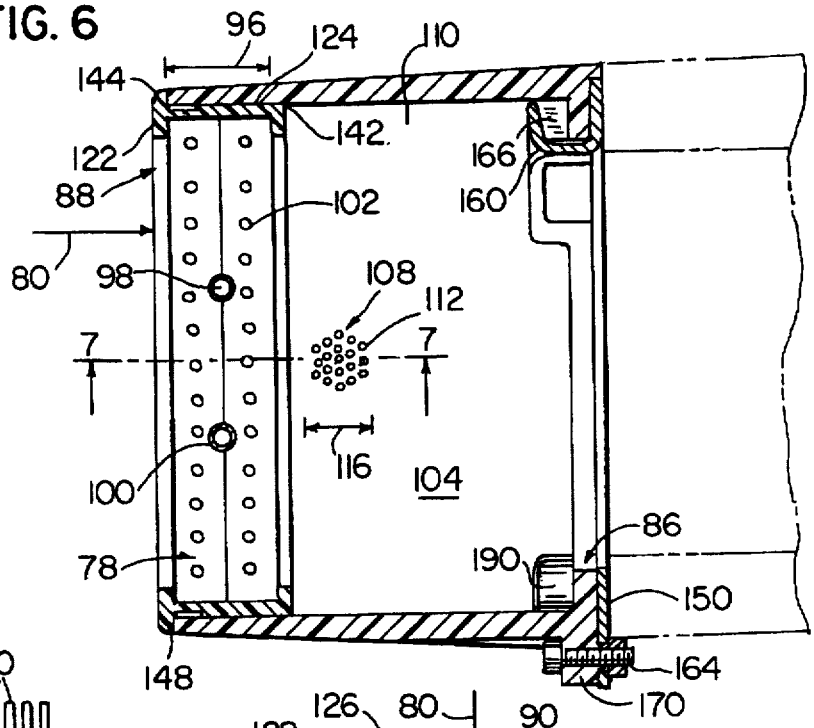
FIG. 8
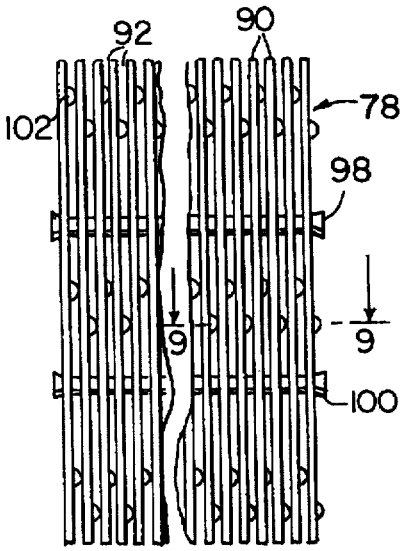
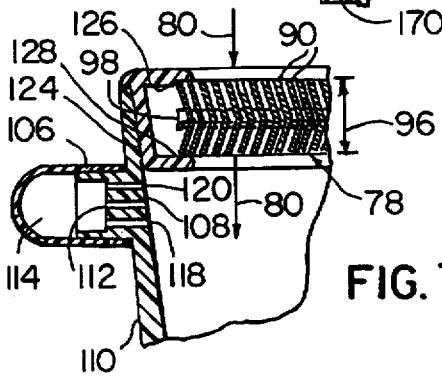
FIG. 7
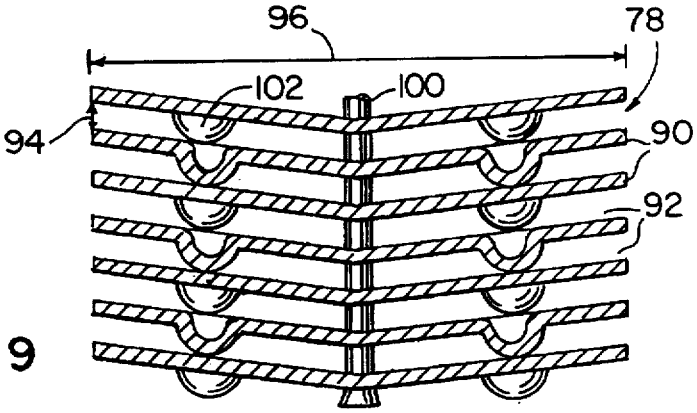
FIG. 9

FLAME ARRESTOR

BACKGROUND OF THE INVENTION

This invention relates to flame arrestors for marine engines.

Flame arrestors for marine engines are known in the prior art, for example FIG. 1, to be described. The flame arrestor is mounted to the combustion air intake of an enclosed marine engine and passes combustion air therethrough into the air intake and blocks flame propagation in the opposite direction out of the air intake. The flame arrestor includes a cast rim mounted adjacent the air intake and a cast end plate spaced outwardly from the rim by extended mounting bolts. A circumferential flame arresting media such as a wire mesh encircles the space between the rim and the end plate. Combustion air flows through the circumferential area of the flame arresting media and turns and flows into the air intake.

The present invention provides improvements in simplicity, cost reduction, weight reduction, and space efficiency.

BRIEF DESCRIPTION OF THE DRAWINGS

Prior Art

Present Invention

Figures 1, 2, 3:
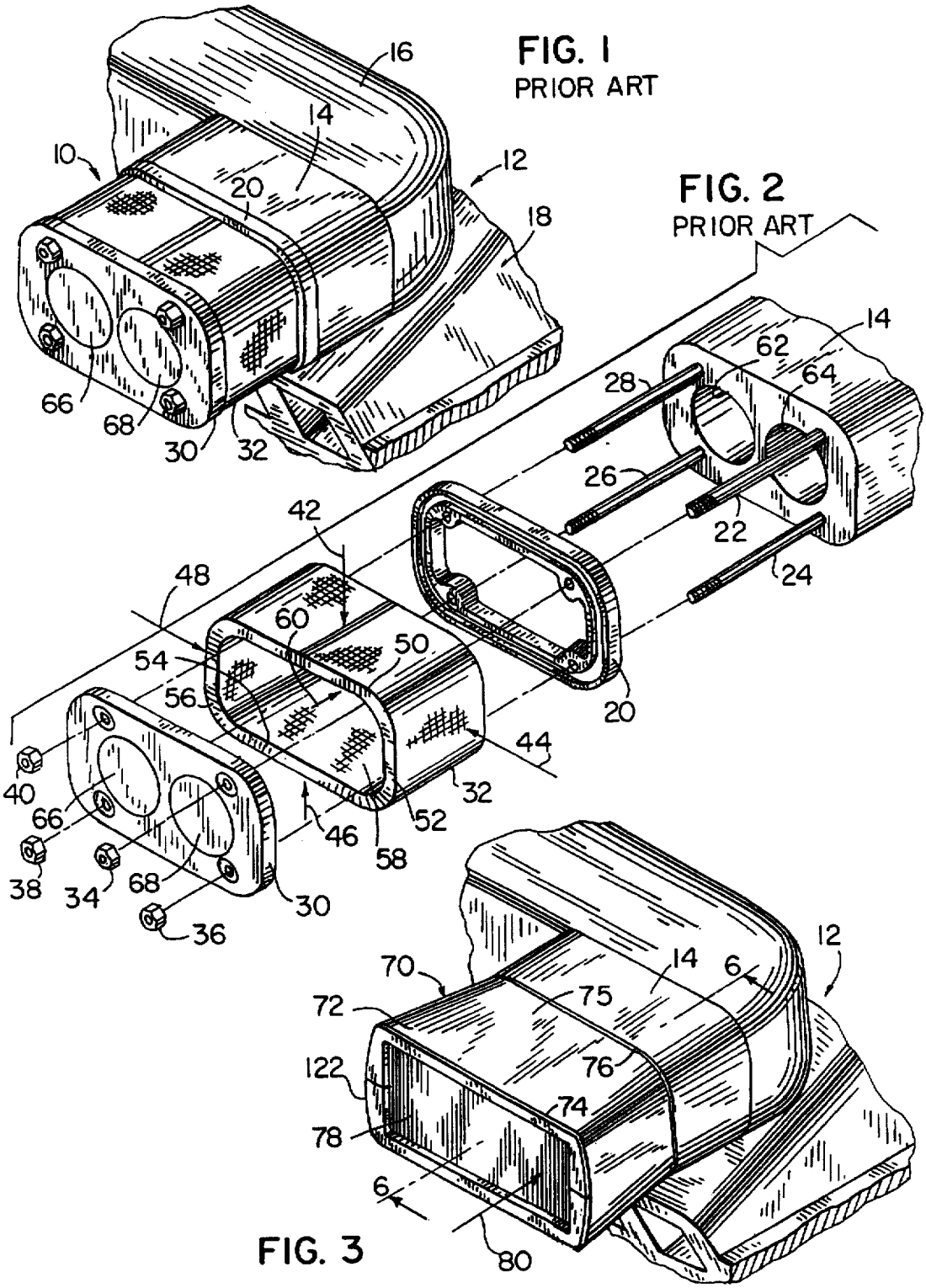
FIG. 1 PRIOR ART
FIG. 2 PRIOR ART
FIG. 1 is a perspective view of a marine engine flame arrestor known in the prior art.
FIG. 2 is an exploded perspective view of a portion of the structure of FIG. 1.

FIG. 3 is a perspective view of a marine engine flame arrestor in accordance with the present invention.

Figure 4:
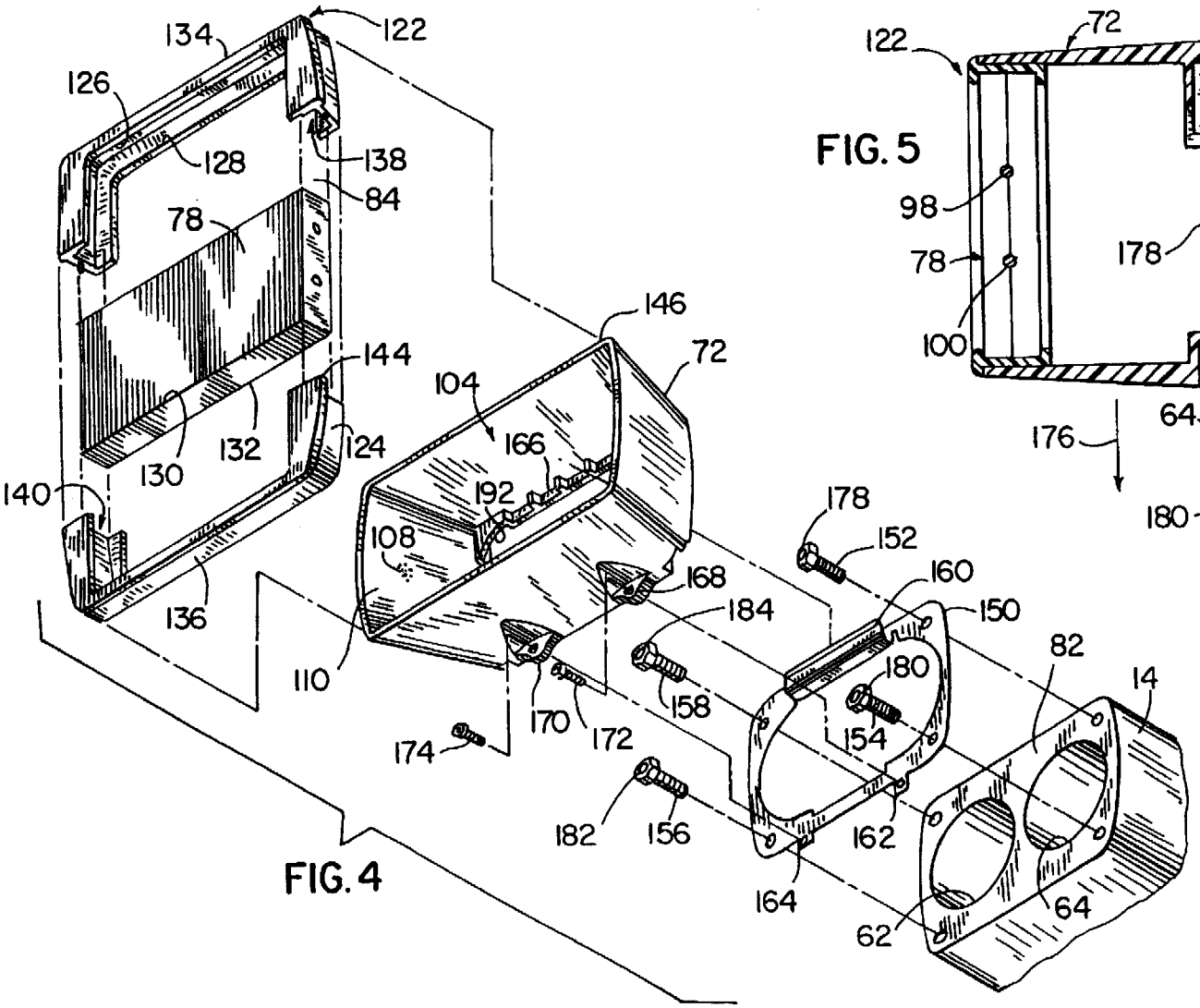

FIG. 4 is an exploded perspective view of a portion of the structure of FIG. 3.

Figure 5:
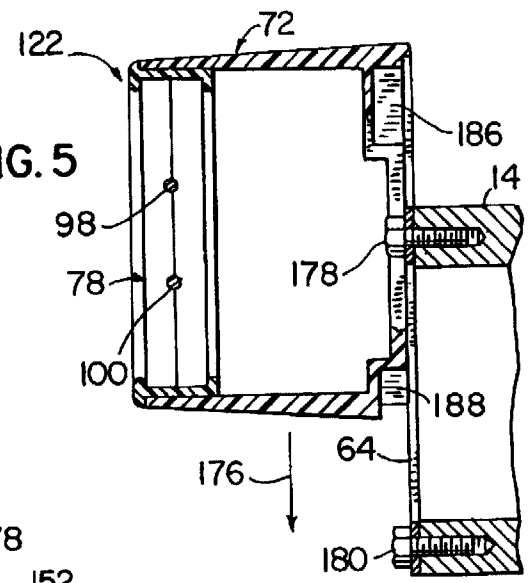

FIG. 5 is a sectional view of a portion of the structure of FIG. 3 during assembly thereof.

FIG. 6 is a sectional view taken along line 6—6 of FIG. 3.

FIG. 7 is a sectional view taken along line 7—7 of FIG. 6.

FIG. 8 is a top view of a portion of the structure of FIG. 4.

FIG. 9 is a sectional view taken along line 9—9 of FIG. 8.

DETAILED DESCRIPTION

Prior Art

FIGS. 1 and 2 show a flame arrestor 10 for a marine engine 12 having a combustion air intake 14 on intake plenum 16 of intake manifold 18. The flame arrestor includes a cast metal rim 20 mounted adjacent combustion air intake 14 by bolts 22, 24, 26, 28. The flame arrestor includes a cast metal end plate 30 spaced from rim 20 by circumferential flame arresting media 32 and mounted to bolts 22, 24, 26, 28 by respective nuts 34, 36, 38, 40. Flame arresting media 32 may take various forms, and in one embodiment is a plurality of layers of expanded metal mesh. Combustion air flows inwardly as shown at arrows 42, 44, 46, 48 through the four respective sides 50, 52, 54, 56 of media 32 into central area 58 and then turns and flows as shown at arrow 60 and flows into openings 62, 64 of air intake 14. Areas 66, 68 on end plate 30 are slightly raised bosses for application of decals or the like, and are not air intake openings.

Present Invention

FIGS. 3–9 show a flame arrestor 70 for marine engine 12 having combustion air intake 14. The flame arrestor includes an air box 72 mounted to air intake 14 and having an upstream end 74 receiving combustion air and a downstream end 76 supplying the combustion air to air intake 14. The flame arrestor includes a uniplanar flame arresting element 78 mounted to air box 72 and passing combustion air therethrough as shown at directional arrow 80 into air intake 14, and blocking flame propagation in the opposite direction out of air intake 14. Unlike flame arrestor 10, FIG. 1, the air flow in flame arrestor 70, FIG. 3, from flame arresting element 78 to air intake 14 is rectilinear. In preferred form, flame arrestor 70 is side mounted to the engine, and the rectilinear air flow at 80 is exclusively horizontal.

Air intake 14 includes the noted ports 62, 64, FIGS. 2 and 4, lying in a plane 82. Flame arresting element 78 lies in a plane 84 parallel to plane 82. Air flow from flame arresting element 78 to air intake 14 is perpendicular to each of planes 82 and 84.

Downstream end 76 of air box 72 has a cross sectional area 86, FIG. 6, in plane 82. Upstream end 74 of air box 72 has a cross sectional area 88 in plane 84. Cross sectional area 88 is larger than cross sectional area 86. In preferred form, flame arresting element 78 is provided by a plurality of leaves 90, FIGS. 7–9, of thin metal material separated by gaps 92 of given width 94 and height 96 arresting a flame front, yet passing combustion air therethrough as shown at arrow 80. Leaves 90 are connected by rivets 98, 100. In an alternative, the leaves may have integral U-shaped bends at their ends to connect the leaves in a multiple fold looped-back chevron configuration, without rivets. The leaves include a plurality of staggered dimples 102 which determine the width 94 of gaps 92. This type of flame arresting element is known in the prior art and available from various commercial sources, for example Barbron Corp. In preferred form, cross sectional area 88 is larger than cross sectional area 86 by substantially the amount of cumulative cross sectional area of leaves 90 in plane 84, such that the cumulative cross sectional area of gaps 92 substantially equals cross sectional area 86.

An advantage of flame arresting element 78 is that it flows air much better than media 32. When media 32 is layers of expanded wire mesh, it has been found that the leave-type element 78 flows air up to four times better than media 32, i.e. four times the volume of air per unit surface area per unit time. Thus, element 78 needs only one-fourth the surface flow area of media 32.

This in turn enables better space utilization and efficiency in the typically enclosed marine engine compartment because other engine components may now be mounted adjacent the sides of air box 72. In contrast, in FIG. 1 there must be sufficient clearance for air flow at 42, 44, 46, 48 into the sides of the flame arrestor, which in turn imposes design restrictions in the engine compartment.

The noted width 94 and height 96 of gaps 92 is significant. There must be sufficient air flow into air intake 14, yet the reverse propagating flame front must be arrested. It has been found that the height 96 of leaves 90 in the direction of air flow 80 therealong should be at least about 0.5 inch, preferably about 0.625 inch, and that leaves 90 should be separated by gaps 92 of width 94 perpendicular to air flow direction 80 by at least about 0.025 inch, preferably about 0.028 inch. It has been found that this combination of height and width arrests a flame front but permits flow of combustion air along arrow 80 into intake 14.

Air box 72 is a rigid molded member defining combustion air flow passage 104 therethrough and supporting flame arresting element 78 spanning such passage. Air box 72 includes a positive crankcase ventilation integral fitting 106, FIG. 7. The fitting includes an integrally molded screen 108, FIGS. 6, 7 and 4, in a sidewall 110 of air box 72 formed by a matrix of a plurality of perforations or apertures 112 in sidewall 110. Perforations 112 form flame arresting passages of given diameter and depth arresting a flame front and extending outwardly from sidewall 110 of air box 72 and then merging in a single common passage 114 for connection to the engine crankcase (not shown) to provide positive crankcase ventilation.

In preferred form, each perforation 112 in the sidewall 110 of air box 72 has a diameter of at least about 0.05 inch, preferably 0.063±0.005 inch, and a depth of at least about 0.25 inch, preferably ranging from 0.28 to 0.38 inch, to be described. It has been found that this combination provides desired ventilation yet arrests a flame front. There are at least about 15, preferably 19, holes or perforations 112 in matrix 108. The diameter 116, FIG. 6, of matrix 108 is about 0.5 inch.

The thickness of the sidewalls of air box 72, including sidewall 110, taper to an increasing thickness from upstream end 74 to downstream end 76, as shown in FIG. 6. The depth of perforations 112 in matrix 108 increases from the upstream end to the downstream end of matrix 108 such that perforations such as 118, FIG. 7, in the matrix toward the downstream end have a greater depth than perforations such as 120 in the matrix toward the upstream end. The variation in depth between downstream perforation 118 and upstream perforation 120 is preferably about 0.1 inch, wherein the depth of downstream perforation 118 is about 0.38 inch, and the depth of upstream perforation 120 is about 0.28 inch.

An advantage of the present design is that it enables air box 72 to be molded from a rigid composite material, affording a significant weight reduction, typically 50% less than the design of FIG. 1, namely 1 lb. versus 2 lbs. This is further desirable in side mounted flame arrestors which are cantilevered from air intake 14 of the engine. Air intake 14 is a metal part. Air box 72 is a rigid molded plastic member, preferably fiber reinforced thermoplastic, further preferably fiber reinforced polyphenylene ether which is approximately 30% by weight fiber reinforced polyphenylene ether. An advantage of air box 72 being plastic is that it enables markings such as certification notices to be molded in place such as on outer surface 75.

Flame arrestor 70 includes a picture frame cap 122, FIGS. 3 and 4, mounted to flame arresting element 78 and extending around the perimeter thereof and mounted to air box 72 by adhesive bonding or the like. Picture frame cap 122 has an outer sidewall 124 engaging the inner sidewall of air box 72. Picture frame cap 122 has inner lips 126 and 128 extending around the inner perimeter thereof and spaced from each other along the direction of air flow 80 and respectively engaging opposite upstream and downstream sides 130 and 132 of flame arresting element 78. Outer sidewall 124 of picture frame cap 122 is tapered inwardly, FIGS. 6 and 7, as it extends toward the downstream end. The point of engagement of inner lip 126 with upstream end 130 of flame arresting element 78 is spaced from outer sidewall 124 by a transverse dimension which is larger than the transverse dimension spacing the point of engagement of inner lip 128 with downstream end 132 of flame arresting element 78 from outer sidewall 124.

Mating halves 134 and 136 of picture frame cap 122 each have respective guide channels 138 and 140 formed by respective inner lips 126 and 128 and slidably receiving flame arresting element 78 inserted along a direction transverse to air flow direction 80 upon assembly of halves 134 and 136. Assembled halves 134 and 136 of picture frame cap 122 with flame arresting element 78 trapped therebetween in guide channels 138 and 140 are mounted to air box 72 at upstream end 74. Picture frame cap 122 lies in the noted plane 84 parallel to the noted plane 82 having ports 62 and 64 of air intake 14. Outer sidewall 124 of picture frame cap 122 engages the inner sidewall of air box 72 along an engagement plane 142, FIG. 6, generally parallel to air flow direction 80. Picture frame cap 122 includes an outer perimeter flange 144 extending outwardly from outer sidewall 124 at the upstream end thereof and engaging air box 72 at outer rim 146, FIG. 4, along an engagement plane 148, FIG. 6, perpendicular to air flow direction 80.

Flame arrestor 70 includes a mounting plate 150, FIG. 4, mounted to air intake 14 by cap screws or bolts 152, 154, 156, 158. Plate 150 has a first portion with a hook 160 thereon, and a second portion with mounting tabs 162 and 164 thereon. Air box 72 is mounted to plate 150 and has a first portion at its downstream end with a ledge or catch 166 engaging hook 160, and a second portion at its downstream end at mounting tabs 168 and 170 for engaging mounting tabs 162 and 164, respectively, and being mounted thereto by respective screws 172 and 174. Air box 72 is initially placed on air intake 14 in an offset position, FIG. 5. Air box 72 is then slid transversely as shown at arrow 176 such that catch 166, FIGS. 4 and 6, slides transversely into engagement with hook 160, and mounting tabs 168 and 170 align with mounting tabs 162 and 164 along an alignment axis parallel to air flow direction 80 upon engagement of catch 166 and hook 160.

Bolts 152, 154, 156, 158 have respective heads 178, 180, 182, 184. Air box 72 has respective clearance slots 186, 188, 190, 192 at the downstream end of air box 72 accommodating and slidable along respective bolt heads as air box 72 slides transversely at 176 in FIG. 5 as catch 166 slides into engagement with hook 160. The respective bolt heads are in respective clearance slots when mounting tabs 168 and 170 of air box 72 are in alignment with mounting tabs 162 and 164 of plate 150.

It is recognized that various equivalents, alternatives and modifications are possible within the scope of the appended claims.

We claim:

1. A flame arrestor for a marine engine having a combustion air intake, comprising an air box mounted to said air intake and having an upstream end receiving combustion air and a downstream end supplying said combustion air to said air intake, a planar flame arresting element mounted to said air box and passing combustion air therethrough in a first direction into said air intake and blocking flame propagation in a second opposite direction out of said air intake.

2. The invention according to claim 1 wherein air flow from said flame arresting element to said air intake is rectilinear.

3. The invention according to claim 2 wherein said flame arrestor is side mounted, and said rectilinear air flow is exclusively horizontal.

4. The invention according to claim 1 wherein said air intake includes a port lying in a first plane, and said flame arresting element lies in a second plane parallel to said first plane.

5. The invention according to claim 4 wherein air flow from said flame arresting element to said air intake is perpendicular to each of said first and second planes.

6. The invention according to claim 5 wherein said downstream end of said air box has a first cross sectional area in said first plane, said upstream end of said air box has a second cross sectional area in said second plane, and said second cross sectional area is larger than said first cross sectional area.

7. The invention according to claim 6 wherein said flame arresting element is at said upstream end and comprises a plurality of leaves of material separated by flame arresting gaps of given width and height arresting a flame front and passing combustion air therethrough.

8. The invention according to claim 7 wherein said second cross sectional area is larger than said first cross sectional area by substantially the amount of cumulative cross sectional area of said leaves in said second plane, such that the cumulative cross sectional area of said gaps substantially equals said second cross sectional area.

9. The invention according to claim 1 wherein said flame arresting element comprises a plurality of leaves of material having a height in the direction of air flow therealong of at least about 0.5 inch and separated by gaps of width perpendicular to said air flow direction of at least 0.025 inch, the combination of said height and said width arresting a flame front in said second direction but permitting flow of combustion air in said first direction.

10. The invention according to claim 1 wherein said air box is a rigid molded member defining a combustion air flow passage therethrough and supporting said flame arresting element spanning said passage.

11. The invention according to claim 10 wherein said rigid molded air box includes a positive crankcase ventilation integral fitting.

12. The invention according to claim 11 wherein said integral fitting includes an integrally molded screen in a sidewall of said air box formed by a matrix of a plurality of perforations in said sidewall forming flame arresting passages of given diameter and depth arresting a flame front and extending outwardly from said sidewall and then merging in a single common passage providing positive crankcase ventilation.

13. The invention according to claim 12 wherein said flame arresting passage is formed by said perforations in said sidewall, each having a diameter of at least about 0.05 inch and a depth of at least about 0.25 inch, which combination arrests a flame front.

14. The invention according to claim 13 wherein said matrix of said perforations has a diameter of about 0.05 inch, and comprising at least about 15 said perforations in said matrix.

15. The invention according to claim 12 wherein the thickness of said sidewall tapers to an increasing thickness from said upstream end to said downstream end, and wherein said depth of perforations in said matrix increases from said upstream end to said downstream end such that perforations in said matrix toward said downstream end have a greater depth than perforations in said matrix toward said upstream end.

16. The invention according to claim 15 wherein the variation in depth between downstream and upstream perforations in about 0.1 inch.

17. The invention according to claim 16 wherein the depth, of downstream perforations in said sidewall is about 0.38 inch, and the depth of upstream perforations in said sidewall is about 0.28 inch.

18. The invention according to claim 1 wherein said air intake is metal, and said air box is a rigid molded plastic member.

19. The invention according to claim 1 wherein said air box is fiber reinforced thermoplastic.

20. The invention according to claim 19 wherein said air box is fiber reinforced polyphenylene ether.

21. The invention according to claim 20 wherein said air box is approximately 30% by weight fiber reinforced polyphenylene ether.

22. The invention according to claim 1 comprising a picture frame cap mounted to said flame arresting element and extending around the perimeter thereof and mounted to said air box.

23. The invention according to claim 22 wherein said picture frame cap has an outer sidewall engaging said air box, and first and second inner lips extending around the inner perimeter thereof and spaced from each other along the direction of air flow and respectively engaging opposite upstream and downstream sides of said flame arresting element.

24. The invention according to claim 23 wherein said outer sidewall of said picture frame cap is tapered inwardly as it extends toward said downstream end, and wherein the point of engagement of said first inner lip with said flame arresting element is spaced from said outer sidewall by a first transverse dimension, the point of engagement of said second inner lip with said flame arresting element is spaced from said outer sidewall by a second transverse dimension, and wherein said first transverse dimension is larger than said second transverse dimension.

25. The invention according to claim 23 wherein said picture frame cap is a two piece member having mating halves each having guide channels formed by respective said inner lips slidably receiving said flame arresting element inserted along a direction transverse to said air flow direction upon assembly of said halves.

26. The invention according to claim 25 wherein said air intake includes a port lying in a first plane transverse to said air flow direction, and wherein the assembled said halves of said picture frame cap with said flame arresting element therebetween are mounted to said air box at said upstream end, and wherein said picture frame cap lies in a second plane parallel to said first plane.

27. The invention according to claim 26 wherein said outer sidewall of said picture frame cap engages said air box along an engagement plane generally parallel to said air flow direction, and wherein said picture frame cap comprises an outer perimeter flange extending outwardly from said outer sidewall at said upstream end and engaging said air box along an engagement plane perpendicular to said air flow direction.

28. The invention according to claim 1 comprising a plate mounted to said air intake and having a first portion with a hook thereon, and a second portion with mounting means thereon, and wherein said air box is mounted to said plate and has a first portion with a catch engaging said hook, and a second portion engaging said mounting means.

29. The invention according to claim 28 wherein each of said first and second portions of said air box is at said downstream end.

30. The invention according to claim 29 wherein said catch on said first portion of said air box is slidable transversely of the direction of air flow into engagement with said hook, and wherein said mounting means of said second portion of said air box and said mounting means of said second portion of said plate align with each other along an alignment axis parallel to said air flow direction upon said engagement of said catch and said hook.

31. The invention according to claim 30 wherein said plate is mounted to said air intake by a plurality of bolts having heads, and wherein said air box has a plurality of clearance slots at said downstream end accommodating and slidable along said bolt heads as said catch slides into engagement with said hook, said bolt heads being in respective said clearance slots when said mounting means of said second portion of said air box is aligned with said mounting means of said second portion of said plate.

32. A flame arrestor for a marine engine having a combustion air intake, comprising an air box mounted to said air intake and having an upstream end receiving combustion air and a downstream end supplying said combustion air to said air intake, said air intake lying in a first plane, a flame arresting element mounted to said air box and passing combustion air therethrough in a first direction into said air intake and blocking flame propagation in a second opposite direction out of said air intake, said flame arresting element lying in a second plane parallel to said first plane.

33. The invention according to claim 32 wherein air flow from said flame arresting element to said air intake is perpendicular to each of said first and second planes.

* * * * *